US006371749B2

(12) United States Patent
Thompson et al.

(10) Patent No.: US 6,371,749 B2
(45) **Date of Patent: *Apr. 16, 2002**

(54) APPARATUS FOR MAKING DIMENSIONALLY STABLE NONWOVEN FIBROUS WEBS

(75) Inventors: Delton R. Thompson, Woodbury; David A. Olson, St. Paul; Pamela A. Percha, Woodbury, all of MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/360,090

(22) Filed: Jul. 23, 1999

Related U.S. Application Data

(62) Division of application No. 09/046,855, filed on Mar. 24, 1998, now Pat. No. 5,958,322.

(51) Int. Cl.[7] ..... D04H 3/03

(52) U.S. Cl. ..... 425/363; 425/446; 425/471; 156/181

(58) Field of Search ..... 28/115, 117; 156/85, 156/161, 181, 229; 264/342 R; 425/363, 378.1, 471, 472, 446

(56) References Cited

U.S. PATENT DOCUMENTS

| | | | | |
|---|---|---|---|---|
| 3,819,465 A | * | 6/1974 | Parsons et al. | 428/176 |
| 3,823,210 A | | 7/1974 | Shii et al. | 264/41 |

(List continued on next page.)

FOREIGN PATENT DOCUMENTS

| | | |
|---|---|---|
| DE | 2 160 209 | 6/1973 |
| EP | 05011111 | 1/1993 |
| JP | 3045768 | 2/1991 |
| JP | 3059158 | 3/1991 |
| JP | 3071829 | 3/1991 |

OTHER PUBLICATIONS

Proceedings: Davies, C.N., "The Separation of Airborne Dust and Particles," *Institution of Mechanical Engineering*, London, Proceedings 1B, 1952.

(List continued on next page.)

*Primary Examiner*—Nam Nguyen
*Assistant Examiner*—Donald Heckenberg
(74) *Attorney, Agent, or Firm*—James A. Rogers; Karl G. Hanson; David R. Cleveland

(57) ABSTRACT

A method and apparatus for tentering nonwoven webs during annealing. The nonwoven web of thermoplastic fibers is restrained on a tentering structure at a plurality of tentering points distributed across an interior portion of the web, rather than just along its edges. The nonwoven web is annealed while restrained on the tentering structure to form a dimensionally stable nonwoven fibrous web, dimensionally stable up to at least the heatsetting temperature. The annealed nonwoven fibrous web is then removed from the tentering structure. In one embodiment, the tentering structure restrains the nonwoven fibrous web in a non-planar configuration during the annealing process. The tentering structure includes a plurality of tentering points projecting distally from a tentering support. The tentering points are positioned to be engaged with an interior portion of the web, thus restraining the web during annealing.

33 Claims, 3 Drawing Sheets

U.S. PATENT DOCUMENTS

| | | | | | |
|---|---|---|---|---|---|
| 3,855,046 | A | * | 12/1974 | Hansen et al. | 161/150 |
| 4,118,531 | A | | 10/1978 | Hauser | 428/224 |
| 4,153,664 | A | * | 5/1979 | Sabee | 264/289 |
| 4,232,434 | A | * | 11/1980 | Pfister | 26/86 |
| 4,252,590 | A | | 2/1981 | Rasen et al. | 156/167 |
| T100,902 | I4 | | 8/1981 | Hauser | 210/348 |
| 4,377,889 | A | * | 3/1983 | Tatham et al. | 28/112 |
| 4,715,924 | A | | 12/1987 | McConnell | 156/433 |
| 4,741,941 | A | | 5/1988 | Englebert et al. | 428/71 |
| 4,988,560 | A | | 1/1991 | Meyer et al. | 428/297 |
| 5,010,165 | A | | 4/1991 | Pruett et al. | 528/272 |
| 5,141,699 | A | | 8/1992 | Meyer et al. | 264/518 |
| 5,298,694 | A | | 3/1994 | Thompson et al. | 181/286 |
| 5,364,694 | A | | 11/1994 | Okada et al. | 428/288 |
| 5,582,905 | A | | 12/1996 | Beck et al. | 428/286 |
| 5,609,808 | A | | 3/1997 | Joest et al. | 264/210.7 |
| 5,753,736 | A | | 5/1998 | Bhat et al. | 524/287 |
| 5,788,804 | A | | 8/1998 | Hörsting | 156/440 |

OTHER PUBLICATIONS

Report: Van A. Wente, "Manufacture of Superfine Organic Fibers," Report No. 4364 of the Naval Research Laboratories, published May 25, 1954.

Article: Van A. Wente, "Superfine Thermoplastic Fibers," *Industrial and Engineering Chemistry*, vol. 48, No. 8, Aug. 1956, pp. 1342–1346.

Standard: "Standard Methods for Gas Flow Resistance Testing of Filtration Media[1]," ASTM Designation: F 778–88 (Reapproved 1993).

Standard: "Standard Test Method for Impedance and Absorption of Acoustical Materials Using a Tube, Two Microphones, and a Digital Frequency Analysis System[1]," ASTM Designation: E 1050–90.

Standard: "Standard Test Method for Linear Dimensional Changes of Nonrigid Thermoplastic Sheeting or Film at Elevated Temperature[1]," ASTM Designation: D 1204–94.

Standard: "Standard Test Method for Thickness of Textile Materials[1]," ASTM Designation: D 1777–96.

Standard: "Standard Test Method for Mass Per Unit Area (Weight) of Fabric[1]," ASTM Designation: D 3776–96.

* cited by examiner

APPARATUS FOR MAKING DIMENSIONALLY STABLE NONWOVEN FIBROUS WEBS

This application is a divisional of Ser. No. 09/046,855, filed Mar. 24, 1998, now U.S. Pat. No. 5,958,322.

TECHNICAL FIELD

The present invention relates to a method and apparatus for making nonwoven fibrous webs that resist shrinkage when exposed to heat.

BACKGROUND

Typical melt spinning polymers, such as polyolefins, tend to be in a semi-crystalline state upon meltblown fiber extrusion (as measured by differential scanning calorimetry (DSC)). For polyolefins, this ordered state is due, in part, to a relatively high rate of crystallization and to the extensional polymer chains orientation in the extrudate. In meltblown extrusion, extensional orientation is accomplished with high velocity, heated air in the elongational field. Extending polymer chains from the preferred random coiled configuration and crystal formation imparts internal stresses to the polymer. Provided the polymer is above its glass transition temperature ($T_g$) these stresses will dissipate. For meltblown polyolefins, the dissipation of stresses occurs spontaneously since the polymer's $T_g$ is well below room temperature.

In contrast, some melt spinning polymers, such as polyethylene terephthalate (PET), tend to be in a nearly completely amorphous state upon meltblown fiber extrusion. This characteristic is attributable to a relatively low rate of crystallization, a relatively high melt temperature ($T_m$), and a $T_g$ well above room temperature. The internal stresses from amorphous orientation within the elongational field are frozen-in due to rapid quenching of the melt, thus preventing relaxation which cannot be released until subsequent annealing above $T_g$. Annealing between $T_g$ and the $T_m$ for sufficient periods allows the polymer to both crystallize and dissipate internal stresses caused by elongational orientation. This stress dissipation manifests itself in the form of shrinkage that can approach values exceeding 50% of the web's extruded dimensions.

The textile and film industries have successfully addressed dimensional instability in woven polyester fabrics and films using edge tentering during heatsetting or annealing. In edge tentering, the woven polyester fabric or film is held along its edges to a desired width as it passes trough an annealing oven. The heatsetting temperature ranges typically from about 177° C. to about 246° C.(350° F. to about 475° F.), and the dwell time ranges from about 30 seconds to several minutes. The annealed article is dimensionally stable up to the heatsetting temperature. While edge tentering is practical for films and woven fabrics, nonwoven fibrous webs typically lack sufficient tensile properties (i.e., fiber and web strength) to withstand conventional edge tentering procedures, resulting in a damaged web.

Various attempts have been made in the art to achieve a dimensionally stable polyester nonwoven fibrous web U.S. Pat. No. 3,823,210 (Hikaru Shii et al.) describes a method of manufacturing an oriented product of a synthetic crystalline polymer. The patent discloses drawing a crystalline polymer, applying tensile stress in the direction of the draw axis in a heated solvent, and under this condition extracting the soluble fractions of the drawn material.

U.S. Pat. No. 5,010,165 (Pruett et al.) describes a dimensionally stable polyester melt blown web achieved by treating a melt blown web composition with a solvent where the solvent has a certain solubility parameter, and drying the melt blown web composition.

U.S. Pat. No. 5,364,694 (Okada et al.) teaches that PET cannot give a meltblown web with small thermal shrinkage unless the melt-blowing operation is conducted at higher viscosity and with air under higher pressure than these melt-blowing conditions employed for other readily-crystalline polymers such as polypropylene. The patent teaches stable operation with high productivity is impossible under such strict conditions. The patent discloses that blending the PET with 2 to 25% of a polyolefin decreases the melt viscosity of the entire blend so that the polymer extrudates can be attenuated into fibers even by the comparatively weak force exerted by a low-pressure air of not more than 1.0 kg/cm$^2$. The extruded polyolefin has a high crystallization rate. In the blend, the polyolefin forms minute islands in a continuous sea of PET. The multiplicity of crystallized polyolefin islands constitute restricting points that suppress movement of amorphous molecules of PET when the web is heated, thereby preventing the nonwoven fabric from shrinking to a large extent.

U.S. Pat. No. 5,609,808 (Joest et al.) describes a method of making a fleece or mat of filaments of a thermoplastic polymer having both a crystalline and an amorphous state. A melt-blowing head is operated under conditions to produce long filaments, which are collected on a sieve belt and form crossing welds at cross-over points. The resulting web is composed of filaments having a diameter of less than 100 micrometers and a degree of crystallinity of less than 45%. The web is heated to a stretching temperature of 80° C. to 150° C. and is then biaxially stretched by 100% to 400% before being thermally fixed at a higher temperature. The stretching station can have a downstream pair of rolls which are driven at a certain speed and an upstream pair of rolls driven at a higher speed to effect the longitudinal stretching. Transverse stretching is effected between pairs of diverging chains.

SUMMARY OF THE INVENTION

The present invention provides a method and apparatus for making a dimensionally stable or shrink-resistant nonwoven web of polymeric fibers. The resulting dimensionally stable, nonwoven fibrous webs can be used at higher temperatures with minimal change in fiber diameter, size, or physical properties as compared to conventional polyolefin webs. Nonwoven fibrous polyester webs dimensionally stabilized using the present method and apparatus are particularly useful as thermal and acoustical insulation.

The present method of making nonwoven fibrous webs does not require the use of additives that can have an undesirable impact on the base polymer properties. For example, polymer additives and polymer blends formulated to increase the dimensional stability of PET typically lower the melting point and glass transition temperature of the PET. This reduction in melting point and glass transition temperature negatively impacts on the use of PET for high temperature applications, such as automotive engine compartment noise attenuators.

In one embodiment, a nonwoven web of thermoplastic fibers is restrained on a tentering structure at a plurality of tentering points distributed across an interior portion of the web, rather than just along its edges. The nonwoven web is annealed while restrained on the tentering structure to form a nonwoven fibrous web, dimensionally stable up to at least the heatsetting temperature. The annealed nonwoven fibrous web is then removed from the tentering structure. In one embodiment, the tentering structure restrains the nonwoven fibrous web in a non-planar configuration during the annealing process.

The present invention also relates to a tentering structure for annealing nonwoven fibrous webs. The tentering structure includes a plurality of tentering points projecting distally from a tentering support. The tentering points can restrain the web in two or three dimensions.

As used herein,

"crystallization temperature ($T_c$)" is the temperature where a polymer changes from an amorphous to a semicrystalline phase.

"dimensionally stable" refers to a nonwoven fibrous web that suffers preferably less than 20% shrinkage, more preferably less than 10% shrinkage, and most preferably less than 5% shrinkage, along its major surface when elevated to the temperature at which the nonwoven fibrous web was annealed.

"glass transition temperature ($T_g$)" is the temperature where a polymer changes to a viscous or rubbery condition from a glassy one.

"heatsetting" or "annealing" refers to a process of heating an article to a temperature greater than ($T_g$) for some period of time and cooling the article.

"heatsetting temperature" refers to the maximum temperature at which the nonwoven fibrous webs are heated or annealed.

"melting point ($T_m$)" is the temperature where the polymer transitions from a solid phase to a liquid phase.

"nonwoven fibrous web" refers to a textile structure produced by mechanically, chemically, and/or thermally bonding or interlocking polymeric fibers.

"microfiber" refers to fibers having an effective fiber diameter of less than 20 micrometers.

"percent crystallinity" refers to the fraction of the polymer which possesses crystalline order. The crystalline fraction may include nearly perfect crystalline domains as well as domains possessing various levels of disorder, but yet be distinguishable from the lack of order present in an amorphous material.

"polymeric" means a material that is not inorganic and contains repeating units and includes polymers, copolymers, and oligomers.

"staple fiber" refers to fibers cut to a defined length, typically in the range of about 0.64 centimeters to about 20.3 centimeters and an actual fiber diameter of at least 20 micrometers.

"tentering point" refers to a discrete location where the nonwoven fibrous web is secured during annealing.

"thermoplastic" refers to a polymeric material that reversibly softens when exposed to heat.

"ultimate percent (%) crystallinity" refers to the practical maximum achievable percent crystallinity for a material.

BRIEF DESCRIPTION THE DRAWING

DETAILED DESCRIPTION OF THE PREFERRED EMBODIMENTS

Figure 1:
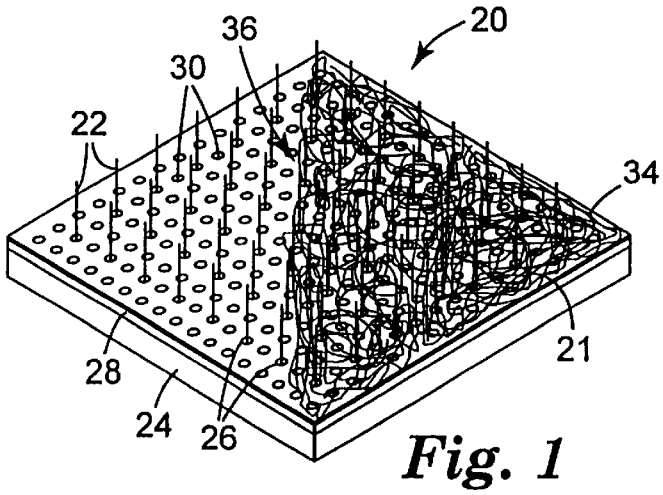
FIG. 1 is a perspective view of a tentering apparatus and a cut-away portion of a nonwoven fibrous web in accordance with the present invention.

FIG. 1 is a perspective view of a first embodiment of an annealing apparatus 20 designed to hold a nonwoven fibrous web 21 stationary at a plurality of tentering points during annealing or heatsetting. A plurality of retractable tentering pins 22 are mounted to a tentering pin support 24. In the embodiment illustrated in FIG. 1, the tentering pins 22 are inserted through a plurality of tentering pin holes 26 on a backing 28. The tentering apparatus 20 of FIG. 1 restrains the nonwoven web 21 along its major surface (x and y axes), but not along the z-axis. The tentering pin support 24 and the backing 28 includes a plurality of vent holes 30 to permit airflow through the surface of a nonwoven web 21 engaged with the annealing apparatus 20. The tentering apparatus 20 avoids compressing the nonwoven web 21 of microfibers during annealing to preserve the acoustical and thermal insulating properties.

Unlike conventional edge tentering used to anneal films and woven fabrics, the tentering pins 22 of FIG. 1 are configured to restrain the nonwoven fibrous web 21 at a plurality of locations at interior portion 36. Edge portions 34 can also be restrained. Edge portion 34 refers to the perimeter of the web that is typically restrained during conventional edge tentering of films or woven fabrics. For most edge tentering applications the edge portions 34 typically comprise less than about 5% of the major surface of the web. Interior portion 36 refers to the major surface of the web, exclusive of the edge portions 34. That is, the interior portion 36 is typically the surface area of the web not restrained by conventional edge tentering techniques. The interior portion typically comprises at least 95% of the surface area of the web. The distribution of the tentering pins 22 across the interior portion of the web 21 allows the contraction forces of relaxation and subsequent crystallization during annealing to be distributed generally uniformly across the web 21, with minimal web shrinkage or tearing.

The spacing between the retractable tentering pins 22 is optimized to prevent fiber-to-fiber slippage due to shrinkage during annealing. In one embodiment, the pins 22 form a grid, with each pin 22 separated by about 2.5 centimeters to about 50 centimeters. In another embodiment, the annealing apparatus 20 comprises a single row of pins 22 arranged to engage with the center of the interior portion 36 of the web 21. The length of the retractable tentering pins 22 can be adjusted depending on the thickness of the nonwoven fibrous web. Although the embodiment illustrated in FIG. 1 shows the pins 22 arranged uniformly on the annealing apparatus 20, a random arrangement of tentering pins 22 is also possible.

Spacing of the pins 22 depends upon the bulk density of the web 21, the effective fiber diameter of the fibers, the thickness of the web, the material from which the web is constructed and other factors. Effective fiber diameter (EFD) is calculated according to the method set forth in Davies, C.N., "The Separation of Airborne Dust and Particles," Institution of Mechanical Engineers, London, Proceedings 1B, 1952.

After annealing is completed, the tentering pin support 24 can be separated from the backing 28 so that the tentering pins 22 are retracted from the fibrous web 21. Alternatively, the nonwoven fibrous web 21 can be lifted off of the tentering structure 20.

Figure 2A:
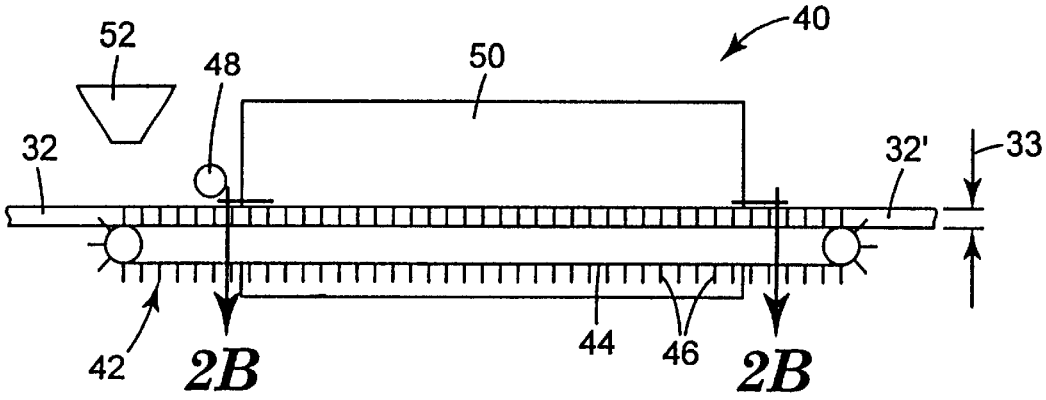
FIG. 2A is a partially broken side view of an alternate apparatus for tentering a nonwoven fibrous web in accordance with the present invention.
Figure 2B:
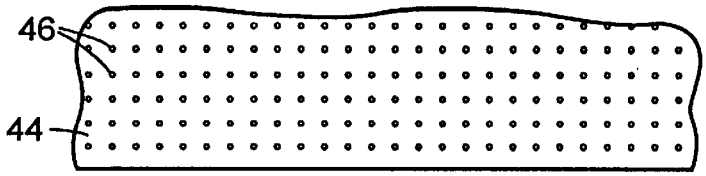
FIG. 2B is a top sectional view of the apparatus of FIG. 2A.

FIGS. 2A and 2B illustrate a continuous annealing apparatus 40 in which nonwoven web 32 is engaged with a tentering structure 42. The tentering structure 42 includes a moving belt 44 having a plurality of tentering pins 46 extending distally away from the belt 44. The tentering pins 46 are arranged across the width "w" of the belt 44 to penetrate into the interior portion of the web 32. A roller 48 may optionally be provided for forcing the nonwoven fibrous web 32 onto the tentering pins 46. The moving belt 44 rotates to draw the nonwoven fibrous web 32 through an annealing oven 50. A variety of energy sources can be used in the annealing oven 50, such as steam, heated air, infrared, x-ray, electron beam, etc. After annealing, the annealed nonwoven fibrous web 32' is separated from the tentering structure 42 to provide a nonwoven fibrous web dimensionally stable up to at least the heatsetting temperature of the oven 50.

In the embodiment illustrated in FIGS. 2A and 2B, the tentering pins 46 extend substantially through the thickness 33 of the nonwoven fibrous web 32. Alternatively, the tentering pins 46 can extend part of the way into the nonwoven fibrous web 32. In yet another embodiment, a fiber forming mechanism 52 can be located upstream of the oven 50 to deposit the melt-blown fibers directly onto the tentering structure 42.

Figure 3:
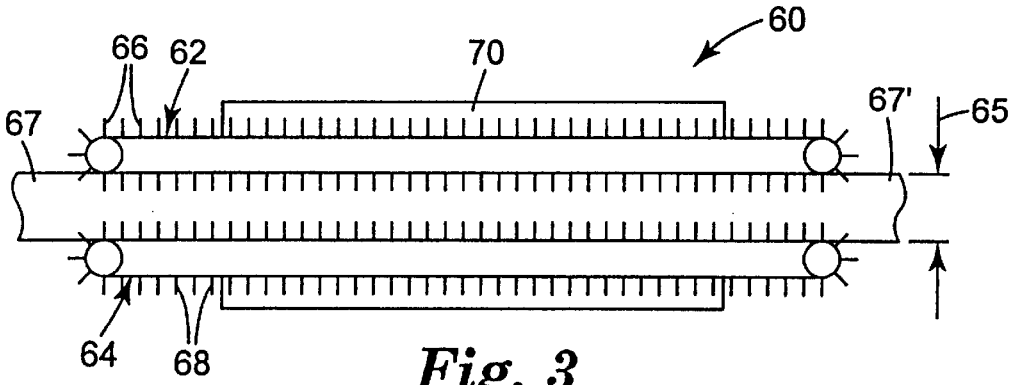
FIG. 3 is a partially broken side view of an alternate apparatus having an upper and a lower tentering apparatus in accordance with the present invention.

FIG. 3 is an alternate annealing apparatus 60 having an upper tentering structure 62 opposite a lower tentering structure 64. In the embodiment illustrated in FIG. 3, the tentering pins 66 on the upper tentering structure 62 extend only part way into the thickness 65 of the nonwoven fibrous web 67. Similarly, the tentering pins 68 of the lower tentering structure 64 extend part way into the nonwoven fibrous web 67. Use of an upper and lower tentering structures 62, 64 allows for shorter tentering pins 66, 68, respectively. The shorter tentering pins 66, 68 facilitate release of the annealed nonwoven fibrous web 67' from the tentering structure 62, 64 after annealing in the oven 70. The sum of the length of the tentering pins 66, 68 can be less than, greater than or equal to the thickness 65 of the nonwoven fibrous web 67. In one embodiment, the upper tentering pins 66 engage with the lower tentering pins 68 within the web 67 during annealing to provide greater lateral strength to the pins. As discussed above, the tentering pins 66, 68 are arranged across the width of the tentering structures 62, 64 to penetrate into the interior portion of the nonwoven fibrous web 67, such as illustrated in FIG. 1.

Figure 4:
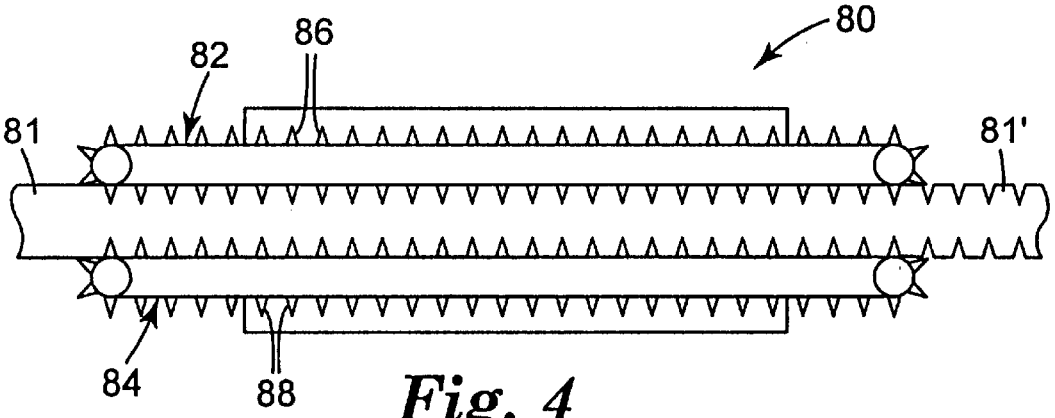
FIG. 4 is a partially broken side view of a compressive tentering apparatus in accordance with the present invention.

FIG. 4 is a side sectional view of an alternate annealing apparatus 80 in which the nonwoven fibrous web 81 is compressibly engaged between an upper tentering structure 82 and a lower tentering structure 84. Rather than penetrating into the nonwoven fibrous web 81, tentering pins 86, 88 restrain the web 81 by compression at discrete locations. The tentering pins 86, 88 are arranged to define compressive tentering points along an interior portion of the nonwoven fibrous web 81, such as illustrated in FIG. 1. In the illustrated embodiment, the tentering pins 86, 88 have a relatively low aspect ratio to increase bending strength and to reduce or eliminate penetration of the pins 86, 88 between the fibers of the web 81. The resulting annealed nonwoven fibrous web 81' has an embossed surface corresponding to the shape of the tentering pins 86, 88. The embodiment of FIG. 4 is particularly useful for nonwoven fibrous webs that are relatively thick, preferably greater than about 5 millimeters thick.

Figure 5:
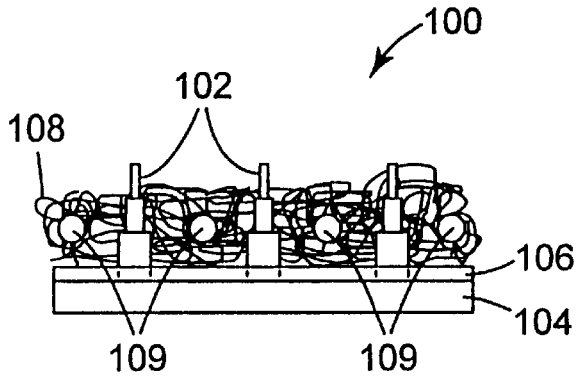
FIG. 5 is a side sectional view of an alternate tentering pin configuration in accordance with the present invention.

FIG. 5 is a side sectional view of an exemplary tentering structure 100 having tapered tentering pins 102 mounted to a tentering pin support 104. The tapered tentering pins 102 facilitate release of the nonwoven fibrous web 108 after the annealing process. A backing 106 may optionally be placed over the tentering pins 102 so that the pins 102 can be retracted from the nonwoven fibrous web 108 after annealing.

In an alternate embodiment illustrated in FIG. 5, a series of horizontally oriented tentering pins 109 are inserted into the web 108 perpendicular to the tentering pins 102. The tentering pins 102 restrain the web 108 in the x-y plane. The tentering pins 109 restrain the web 108 along the z-axis. Restraining the web 108 in three dimensions during annealing preserves loft or thickness.

The tentering pins are preferably constructed from metals such as stainless steel or aluminum. In one embodiment, the tentering pins are coated with a low adhesion material such as polytetrafluoroethylene, or high density polyolefins. Alternatively, the tentering pins and/or the nonwoven fibrous web can be continuously or periodically treated or sprayed with a low adhesion material such as silicone or fluorochemicals to facilitate release of the nonwoven fibrous web.

Figure 6:
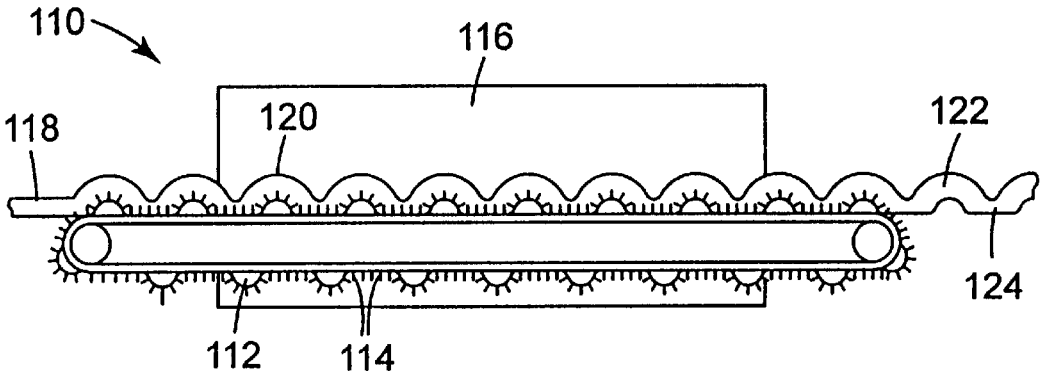
FIG. 6 is a side view of a tentering apparatus for tentering non-planar articles in accordance with the present invention.

FIG. 6 illustrates a non-planar tentering structure 110 having a plurality of shaped structures 112 for forming the nonwoven fibrous web 118 during annealing in the oven 116. Tentering pins 114 are arranged along the entire width and length of the tentering structure 110, including the shaped structures 112. After annealing, the annealed web 124 has formed portions 122 corresponding to the shaped structures 112. The shaped structures 112 can be configured in a variety of shapes, depending upon the application of the annealed article.

Generally, the term "monomer" refers to a single, one unit molecule capable of combination with itself or other monomers to form oligomers or polymers. The term "oligomer" refers to a compound that is a combination of about 2 to about 20 monomers. The term "polymer" refers to a compound that is a combination of about 21 or more monomers.

Polymers suitable for use in this invention include polyamides such as Nylon 6, Nylon 6,6, Nylon 6,10; polyesters such as polyethylene terephthalate, polyethylene naphthalate, polytrimethylene terephthalate, polycyclohexylene dimethylene terephthalate, polybutylene terephthalate; polyurethanes; acrylics; acrylic copolymers; polystyrene; polyvinyl chloride; polystyrene-polybutadiene; polysterene block copolymers; polyetherketones; polycarbonates; or combination thereof. The fibers in the fibrous web may be formed from a single thermoplastic material or a blend of multiple thermoplastic materials, such as, for example, a blend of one or more of the above listed polymers or a blend of any one of the above listed polymers and a polyolefin. In one embodiment, the fibers are extruded to have multiple layers of different polymeric materials. The layers may be arranged concentrically or longitudinally along the fiber's length.

Although the present method and apparatus for making a dimensionally stable nonwoven fibrous web is applicable to a variety of thermoplastic material, a dimensionally stable nonwoven polyester web is particularly useful for acoustical and other insulating properties for automotive engine compartments, appliance motor compartments, and a variety of other high temperature environments. Polyesters also offer significant advantages in applications including medical, surgical, filtration, thermal and acoustical insulation (see U.S. Pat. No. 5,298,694 (Thompson et al.)), protective clothing, clean room garments, personal hygiene and incontinent products, geotextiles, industrial wipes, tenting fabrics, and many other durable and disposable composites.

Polyester melt-blown nonwoven fibrous webs have a unique combination of high strength, elongation, toughness, grab strength, and tear strength compared to other nonwoven polymeric webs, such as polypropylene nonwoven webs. Polyester nonwoven webs can be made with a high degree of rigidity or stiffness as compared to olefinic webs. This stiffness is inherent in polyester due primarily to its higher modulus values. Additionally, flame retardant properties are more easily imparted to polyester nonwoven fibrous webs as compared with olefinic fibrous webs.

Polymeric fibers are typically made by melting a thermoplastic resin and forcing it through an extrusion orifice. In the meltblown process, the fibers are extruded into a high velocity airstream that effectively stretches or attenuates the molten polymer to form fibers. The fibers are then condensed (separated from the airstream) and collected as a randomly entangled or nonwoven web. For example, nonwoven fibrous webs can be made using melt-blowing apparatus of the type described in Van A. Wente, "Superfine Thermoplastic Fibers," *Industrial Engineering Chemistry* vol. 48, pp. 1342–1346 and in Report No. 4364 of the Naval Research Laboratories, published May 25, 1954, entitled "Manufacture of Super Fine Organic Fibers" by Van A. Wente et al.

When a high velocity gaseous stream is not used, such as in the spun bond process, a continuous fiber is deposited on a collector. After collection, the continuous fiber is entangled to form a nonwoven web by a variety of processes known in the art, such as embossing or spraying with water (hydroentangling). For thermal and acoustical insulation applications, staple fibers can be combined with the fibers to provide a more lofty, less dense web. Nonwoven webs containing microfibers and crimped bulking staple fibers used for thermal insulation are disclosed in U.S. Pat. No. 4,118,531 (Hauser) and United States Defensive Publication No. T100,902 (Hauser).

A method and apparatus for making molecularly oriented, melt-blown fibers, and particularly oriented polyester fibers, suitable for use in the present invention are disclosed in U.S. Pat. No. 4,988,560 (Meyer et al.) and U.S. Pat. No. 5,141,699 (Meyer et al.). Fibers of polyesters, such as polyethylene terephthalate (PET), tend to be in an amorphous state when made by conventional melt-blowing procedures, as is seen by differential scanning calorimetry (DSC). Tensioning and attenuation of the fibers during extrusion enhances molecular orientation within the fiber. The fibers are then cooled in an oriented amorphous state. The oriented amorphous fibers have sufficient toughness, flexibility, and strength to form a web which can be annealed using the present method and apparatus for tentering. Additionally, the retained amorphous molecular orientation serves to strain induce (nucleate) crystallinity within the fiber during the subsequent annealing process. The resulting annealed web is dimensionally stable web up to, or exceeding, the heat-setting temperature.

While not wishing to be bound, it is believed that the nuclei or crystal "seeds" generated during extrusion are present in the form of minute islands of "more ordered" material within a continuous sea of amorphous polyester. The multiplicity of these ordered sites within the amorphous material serves as nuclei for crystallization of the polyester fibers during the annealing process. Crystallization is maximized by elevating the temperature above the glass transition temperature ($T_g$) (about 70° C. to about 80° C. for PET) of the material during annealing.

It is also believed that the molecular orientation within the material concurrently serves as restricting points within the matrix of amorphous material. These oriented regions or "molecular links" suppress the contraction of the amorphous material, during which time the crystallization process progresses. After annealing or heatsetting, the crystals take over the role previously filled by the molecular orientation, and serve as physical crosslinks which suppress movement of the amorphous molecules, and hence, the web. For example, a nonwoven fibrous web of PET will typically not shrink more than about 2% when a level of 13% crystallinity or greater is generated during tentering, as discussed below.

Crystallinity as an Indicator of Dimensional Stability in Nonwoven Fibrous Webs

An amorphous, oriented nonwoven microfiber web is dimensionally unstable if annealed at a temperature greater than the glass transition temperature and not restrained. The dimensional changes encountered when the amorphous, oriented microfibers retract during annealing can be stabilized by generating crystalline regions within the fibers. The crystals act as physical links within the fiber up to their respective melting temperatures. Dimensional change is the greatest when the microfibrous web is totally amorphous. In contrast, the greatest dimensional stability occurs when the fibers are highly crystalline. Therefore, percent crystallinity can be used as one measure of dimensional stability for nonwoven fibrous webs annealed using the present method and apparatus.

Evaluation of Crystalline Content of Nonwoven Fibrous Webs

Percent crystallinity in polymers has been approximated in the past with standard differential scanning calorimetry (DSC) for cases where little or no initial crystallinity is present. Common practice is to subtract any exothermic peak area (cold-crystallization at $T_c$) from the endothermic peak (melting at $T_m$), and use the heat of fusion "remainder" divided by the theoretical heat of fusion to approximate the crystallinity present before the start of the experiment. This method does not reproducibly approximate initial percent crystallinity when working with polyethylene terephthalate which is amorphous, or only slightly crystalline. The error lies in the baseline region between $T_c$ and $T_m$, which can be evaluated incorrectly using DSC. The standard DSC heat flow signal is a "system average" in that it is the convolution of endothermic and exothermic events. The "system average" heat flow signal appears stable, (i.e. the baseline looks flat between $T_c$ and $T_m$) and implies that there is no crystallization, crystal perfection, or melting occurring until an artificially high temperature. This typically results in a falsely high ranking of crystalline content for samples of lesser actual crystallinity. Web samples evaluated with standard DSC would also be incorrectly ranked for crystalline content. As a result of the limitations of standard DSC analyses, samples calculated to have for example about 20% initial crystallinity may in fact be essentially amorphous prior to the test, and would show shrinkage on exposure to temperatures greater than the heat setting temperature. In contrast, samples shown to have about 20% initial crystallinity by Modulated® Differential Scanning Calorimetry (MDSC) and the method described below, will instead be dimensionally stable to a temperature equal to, or greater than, the heatsetting temperature. MDSC provides a method for reliably estimating percent crystalline content, which is proportional to the dimensional stability of the web, i.e. as web crystalline content increases, dimensional stability increases as well.

The specimens were analyzed using the TA Instruments (located in New Castle, Del.) 2920 Modulated® Differential Scanning Calorimeter (MDSC). A linear heating rate of about 4° C./min. was applied with a perturbation amplitude of about±0.636° C. every 60 sec. The samples were subjected to a cyclic heat-cool-heat program ranging from about −10 to about 310° C. The glass transition temperatures reported (° C) are the midpoints in the change in heat capacity seen over the step transition. The step transition is analyzed using the reversing signal curve. The transition temperatures noted from endothermic and exothermic transitions are the maximum values ($T_{peak\ max\ or\ min}$). The integrated peak values are denoted as HF (heat flow), R (reversing or heat capacity related heat flow) and NR (non-reversing heat flow or kinetic effects).

Figure 7:
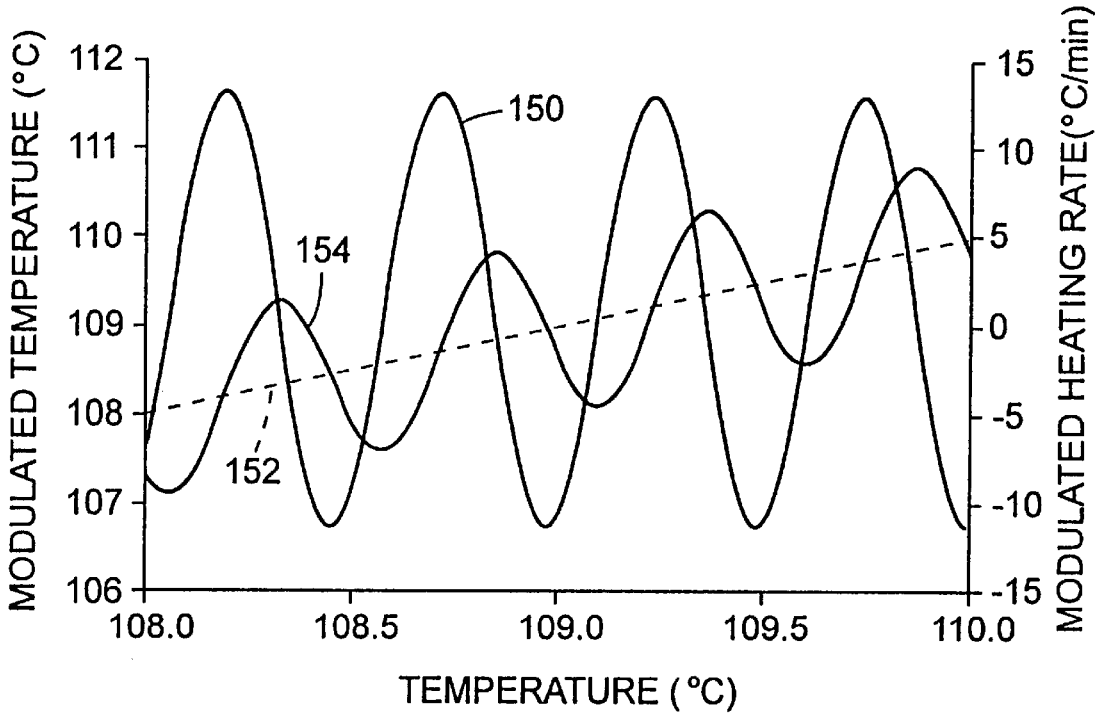
FIG. 7 is an exemplary MDSC heating profile.

A MDSC is similar to a standard DSC in hardware features, however, it uses a distinctly different heating profile. Specifically, the new technique relies upon programming differences in the heating profile applied concurrently to the specimen and reference. In MDSC, a sinusoidal perturbation 154 is overlaid on top of the standard linear heating rate 152 as shown in the exemplary MDSC heating profile of FIG. 7. The result is a continuously changing heating rate 150 with respect to time, but not linearly. The heat flow data which results from the application of this complex heating program is also modulated, and the y-axis magnitude of the signal is proportional to heat capacity.

Figure 8:
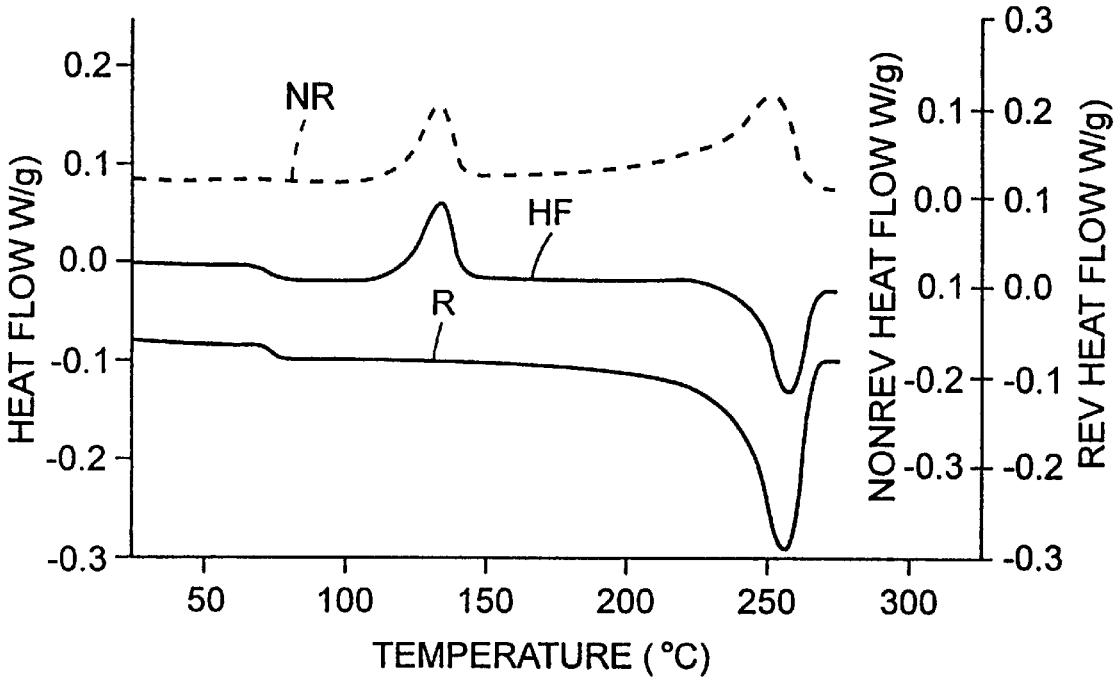
FIG. 8 illustrates exemplary heat flow signals for the heating profile of FIG. 7.

After collection, the raw data is deconvoluted into three components (FIG. 8) using Fourier mathematics, the first a Fourier average signal (HF), the second a function of heat capacity (R), and the third (NR) the difference of the first and second curves noted above. The heat flow signals for quenched PET shown in FIG. 8 are for purposes of illustration only. The amplitude of the modulated, raw signal is corrected by the calibration constants to generate heat capacity based information. Material transitions which result from heat capacity changes deconvolute into the reversing curve after data reduction, while kinetic effects (cold crystallization or crystal perfection) separate into the non-reversing signal. The heat flow signal is equivalent to a standard DSC heat flow signal, and is quantitative. The pair of "reversing+non-reversing" signals are also quantitative as a set, but not when considered separately.

When a moderately fast crystallizing material like PET is tested in a standard DSC, the percent crystallinity values determined by subtracting the cold-crystallization peak from the melting peak before scaling to the theoretical heat of fusion will be reasonably accurate and reproducible, only when the material is already partially crystalline. After a specimen has been annealed sufficiently to generate "some" crystallinity, a more representative baseline is seen in a standard DSC trace between $T_c$ and Tm, and allows the crystallinity approximation method described above to track with the observed physical properties of the polymer. The heat supplied during the test itself no longer significantly affects the crystalline content of the material as it is heated through the typical cold-crystallization region. MDSC allows the extension of the determination and approximation of initial or "web" percent crystallinity to lower levels of crystalline content, and to amorphous specimens as well by correctly evaluating this mid-region of the heat flow signal.

Initial percent crystallinity in PET is estimated by using the MDSC non-reversing (NR) signal peak area data to approximate the exothermic crystallization contribution to the heat flow signal, while using the reversing (R) signal peak area to estimate the endothermic melting contribution. The difference between the exothermic crystallization component and the endothermic melting signal peak area allows a similar estimation of initial percent crystallinity as is done in the standard DSC, but without the baseline inaccuracies. The following expression is used to estimate the initial crystallinity present in the specimen:

$$[R(-)+NR(+)]/\text{theoretical heat of fusion}\times 100=\%\ \text{crystallinity} \quad (1)$$

where:

R is the peak area integrated in the reversing signal curve, and

NR is the peak area integrated using the non-reversing signal.

The convention used here is to take the endothermic R signal data as negative, the exothermic NR signal data as positive, and percent crystallinity is taken as a positive number as well.

The presence or absence of an exothermic peak (120° C.) in the heat flow (HF) or non-reversing heat flow (NR) signals (FIG. 8) during the first heating can also be used as a tool to evaluate the effectiveness of the tentering process for PET. A specimen which shows a significant exotherm in the non-reversing curve, i.e. one similar in magnitude to the size of the cold-crystallization peak exhibited by an amorphous specimen (Control example) crystallizing will be dimensionally unstable. In contrast, an effectively tentered/annealed specimen will show little, or no exothermic activity in the total or non-reversing signal curves below about 200° C.

When tested under the experimental conditions described here, the difference between the exothermic non-reversing peak area and the endothermic reversing signal peak area will correspond to the percent crystallinity of the web.

By tracking the transformation of the amorphous phase into the semicrystalline phase in the non-reversing MDSC signal, it is possible to evaluate the percent crystallinity of the fibers after annealing. Crystallinity generated and perfected during the MDSC test cycle is tracked by the non-reversing signal peak area. The lower of the two exothermic peaks corresponds to the cold-crystallization of the material, while the higher temperature region (greater than 200° C.) is attributed to crystal perfection. Highly amorphous PET samples generate a significant non-reversing peak response below 200° C. which is indicative of web dimensional instability.

In contrast, a semicrystalline web is dimensionally more stable and will show less relative crystallinity being generated during the MDSC test. This is confirmed by the non-reversing signal peak area as well, i.e. the exothermic peak area below about 200° C. will be absent or smaller than would be seen for a control specimen. Therefore, MDSC is a useful tool to assess microfibrous web dimensional stability. In effect, the MDSC is predicting fiber dimensional stability by watching how unstable the PET crystals are to temperature during the, analysis.

The MDSC results allow prediction of web dimensional stability in the case of partially crystallized materials by reproducibly evaluating initial percent crystallinity in the annealed webs. This method allows ranking of the webs in greater detail than simply "good" or "bad" which was often the effective limit of the standard DSC data. The strength of the MDSC test lies in its ability to effectively evaluate the initial percent crystallinity, and therefore to assess the dimensional stability of the microfiber web. The onset of crystallization or crystal perfection in the non-reversing signal approximately illustrates the maximum use temperature of the web material based on dimensional stability to temperature. This estimation is not accurately possible using standard DSC heat flow curves, with their deceptively flat signal in the intermediate (actual use) temperature range of interest.

EXAMPLES

Examples 1–5 and Comparative Example 1

A polyethylene terephthalate (PET) nonwoven meltblown microfibrous web was produced as described in Wente, Van A., "Superfine Thermoplastic Fiber" in Industrial Engineering Chemistry, vol. 48, page 1342 et. seq. (1956), or in Report No. 4364 of the Naval Research Laboratories, published May 25, 1954, entitled "Manufacture of Superfine Organic Fibers," by Wente, V. A.; Boone, C. D.; and Fluharty, E. L. The targeted web basis weight was 200 grams/meter$^2$. Web basis weight was determined in accordance with ASTM D 3776-85. The nonwoven fibrous web was prepared using PET available from Minnesota Mining and Manufacturing Company, St. Paul, Minn., type 651000, 0.60 I.V.

The samples of Examples 1–5 were annealed using a tentering apparatus generally shown in FIG. 1. The tentering apparatus was an aluminum plate 58.4 centimeters×58.4 centimeters×0.635 centimeters (23 inches×23 inches×0.25 inches) with 6.35 millimeters (0.25 inch) holes bored through the plate and spaced 9.53 millimeters (0.375 inches) on center to provide air flow through the plate and through the web. Between the rows of air holes and offset by 4.76 millimeters (0.188 inches), pins are uniformly spaced 2.86 centimeters (1.125 inches) apart. The pins are 15 gauge×18 gauge×36 gauge×7.62 centimeters CB-A Foster 20 (3-22-1.5B needle punching pins available from Foster Needle Co., Inc. Manitowoc, Wis.).

Each PET web in Examples 1–5 was individually placed onto the tentering apparatus under sufficient hand tensioning to remove slack. The web was pushed onto the tentering pins to the base of the aluminum platform, allowing the pins to hold the web stationary. The tentered webs of Examples 1–5 were each placed into an oven for varying times and temperatures set forth in Table 1 to anneal or heatset the webs. The samples were then removed from the oven and allowed to cool to room temperature.

The samples of Examples 1–5 were then marked with grid lines about 25.4 centimeters×about 25.4 centimeters (10 inches×10 inches) and placed into the oven a second time, except that the webs were unrestrained. The webs were heated to about 190° C. for 10 minutes to measure percent web shrinkage in accordance to ASTM D 1204-84.

Comparative Example C1 was prepared as described above with the omission of restrained tentering. Sample C1 was marked with grid lines about 25.4 centimeters×about 25.4 centimeters (10 inches×10 inches) and annealed at 190° C. for 10 minutes. The annealed web was allowed to cool before being evaluated for percent web shrinkage in accordance with ASTM D 1204-84. The results are set forth in Table 1.

TABLE 1

| Modulated | Differential Scanning Annealing | | Calorimetry Melting | Shrinkage 190° C./10 min. Cold Crystallization | |
|---|---|---|---|---|---|
| Example No. | Time (min) | Temp. (° C.) | $\Delta H_f$ (J/g) | (J/g) | Peak Max. ° C. |
| 1 | 0.72 | 176 | 53 | 9 | 118.8 |
| 2 | 2.24 | 176 | 52 | 0 | — |
| 3 | 7.0 | 176 | 53 | 0 | — |
| 4 | 2.24 | 111 | 53 | 34 | 121.9 |
| 5 | 2.24 | 240 | 51 | 0 | — |
| C1 | — | — | 53 | 35 | 121.9 |

| Modulated | Differential Non- | Scanning | Calorimetry | Shrinkage 190° C./10 min. | |
|---|---|---|---|---|---|
| Example No. | Reversing $\Delta H_f$ (J/g) | Reversing $\Delta H_f$ (J/g) | Crystallinity Calculated (%) | Machine Direction (%) | Cross Direction (%) |
| 1 | 100 | 129 | 21 | 0.6 | 0.0 |
| 2 | 71 | 123 | 38 | 0.6 | 0.0 |
| 3 | 76 | 125 | 35 | 0.0 | 0.0 |
| 4 | 132 | 129 | 0 | 37.5 | 36.2 |
| 5 | 70 | 126 | 41 | 1.2 | 1.2 |
| C1 | 127 | 132 | 4 | 57.3 | 50.4 |

The data of Table 1 shows that the non-tentered sample C1 had very high web shrinkage which exceeded 50% in both the web's machine and cross directions. Annealing or heatsetting using the apparatus in FIG. 1 dramatically improved web dimensional stability. However, the annealing effect is time and temperature dependent and can be monitored through phase changes by Modulated Differential Scanning Calorimetry (MDSC). Examples 1–3 and Example 5 provide both sufficient annealing time and annealing temperature to induce crystallization facilitated by the tentering pins preventing fiber and web slippage. The webs of Example 1–3, 5 had very low web shrinkage during subsequent annealing at 190° C. for 10 minutes.

Example 4 shows the effect of insufficient annealing temperature. If the annealing temperature is below the polymer's crystallization temperature, web stabilization to subsequent annealing or higher annealing temperatures will not occur. This effect is indicated by a large exotherm such as would be evident in an MDSC heating profile for Example 4 and Comparative Example 1 for cold crystallization. It appears that web dimensional stabilization to subsequent annealing is due to crystallization during heatsetting. As the crystallization potential within the polymer decreases, web dimensional stabilization increases and web shrinkage decreases.

Polymer percent crystallinity was calculated in the extruded webs prior to shrinkage testing by taking the difference of the Reversing heat flow energy per gram and the Non-Reversing heat flow energy per gram and dividing by the theoretical enthalpy of melting for PET (138 Joules/gram). The samples of Examples 1–3 and Example 5 show a high initial percent crystallinity (exceeding 20%) and small cold crystallization exotherms (as would be evident in an MSDC heating profile). Tenter annealing above the polymer's crystallization temperature with the apparatus in FIG. 1 induced crystallization and imparted web dimensional stabilization. Example 4 shows the significance of tenter annealing above the polymer's peak maximum crystallization temperature of 121.9° C. Tentering below this annealing temperature, the web has a percent crystallinity approaching zero and was consequently, dimensionally unstable to subsequent annealing operations, particularly above 121.9 C°. Comparative Example 1 shows the effect of not tentering the web during annealing. The extruded melt-blown web was essentially non-crystalline (less than 13%) or amorphous. It is difficult to strain induce crystallization in PET melt-blown webs (exceeding 20%) since the fiber melt is difficult to attenuate with air, and the required air velocities typically exceed the polymer's melt strength and results in filament breakage.

An amorphous PET web will shrink significantly once annealed unrestrained above its crystallization temperature, such as exhibited by Comparative Example C1. Lastly, when a web is allowed to cold crystallize in an unrestrained state, the resulting web is typically brittle, possibly due to large and unoriented crystal growth. Tenter annealing above the polymer crystallization temperature with the apparatus in FIG. 1 strain induces crystallization. This ordered structure imparts a flexible and dimensionally stable nonwoven fibrous web.

Examples 6–10 and Comparative Examples 2–6

A polyethylene terephthalate (PET) nonwoven meltblown microfibrous web with a targeted basis weight of 200 grams/meter$^2$ was produced as described in Examples 1–5 and Comparative Example 1. The extruded web was cut into samples 50.8 centimeter×50.8 centimeter (20 inches×20 inches). The webs of Examples 6–10 were placed onto the tentering apparatus of Examples 1–5 and restrained during annealing at various temperatures set forth in Table 2 for 5 minutes. The samples were subsequently removed, allowed to cool to room temperature, marked with grid lines 20.3 centimeters×20.3 centimeters (8 inches×8 inches), and annealed again in an untentered state at 170° C. for 5 minutes. With the exception of sample dimensions, the machine direction web shrinkage was measured in accordance with ASTM D 1204-84. Comparative Examples C2–C5 were prepared as described above except that the webs were not tentered. The webs of C2–C5 were marked with grid lines 20.3 centimeters×20.3 centimeters (8 inches×8 inches), annealed without tentering (in a relaxed condition) at various temperatures set forth in Table 2 for 5 minutes. With the exception of sample dimensions, machine direction web shrinkage was determined in accordance with ASTM D 1204-84. The results are set forth in Table 2.

TABLE 2

| Example No. | Tentered Annealing ° C./ 5 min. | % Shrinkage 170° C./ 5 min. | Unrestrained Annealing ° C./5 min | % Shrinkage | Comments |
|---|---|---|---|---|---|
| 6 | 90 | 56.3 | — | — | Brittle & Stiff |
| 7 | 110 | 10.9 | — | — | Soft & Pliable |
| 8 | 130 | 0.0 | — | — | Soft & Pliable |
| 9 | 150 | 0.0 | — | — | Soft & Pliable |
| 10 | 170 | 0.0 | — | — | Soft & Pliable |
| C2 | — | — | 90 | 30.0 | Soft & Pliable |
| C3 | — | — | 110 | 58.8 | Stiff |
| C4 | — | — | 130 | 60.0 | Very Stiff |
| C5 | — | — | 150 | 60.0 | Stiff & Brittle |
| C6 | — | — | 170 | 60.0 | Stiff & Brittle |

The samples of Examples 6–10 show the influence of increasing tenter annealing temperature for 5 minutes when using the apparatus in FIG. 1. Once the crystallization point of approximately 122° C. for PET was surpassed during tenter annealing, the web was dimensionally stable up to at least the heatsetting temperature. The annealed web was soft and pliable. Relaxed annealing above the crystallization temperature of the polymer results in very high shrinkage, and stiff, brittle webs possibly due to large and unoriented crystal growth.

Examples 11–14

Polyethylene terephthalate (PET) nonwoven meltblown microfibrous webs with a targeted basis weight of 200 grams/meter$^2$ were produced as described in Examples 1–5. The PET meltblown microfibrous webs were prepared from various Intrinsic Viscosity PET resins set forth in Table 3 (available from 3 M Company and from Eastman Chemical Products, Inc. of Kingsport, Tenn.). The annealed webs were evaluated for the effect of I.V. on unrestrained web shrinkage in accordance with ASTM D 1204-84. The results are set forth in Table 3.

TABLE 3

| Example No. | PET Resin Identification | I.V. | % Unrestrained Shrinkage Machine Direction 200° C./10 minutes |
|---|---|---|---|
| 11 | 3M 651000 | 0.60 | 57.1 |
| 12 | Eastman 12440 | 0.74 | 58.3 |
| 13 | Eastman 9663 | 0.80 | 58.3 |
| 14 | Eastman 12822 | 0.95 | 57.1 |

The data of Table 3 show that I.V. did not appear to be an influencing factor on PET web dimensional stabilization within the range of 0.60 to 0.95 I.V.

Examples 15 and Comparative Example C7

Nonwoven acoustical insulating webs were prepared as described in U.S. Pat. No. 4,118,531 (Hauser). The webs comprised 65% melt blown microfibers prepared from polyethylene terephthalate (PET) 0.60 I.V. These webs also comprised 35% crimp bulking fibers in the form of 3.8 centimeter (1.5 inch) long, 6 denier (25.1 micrometers in diameter), 3.9 crimps/centimeter (10 crimps per inch) polyester staple fibers available as Type T-295 fibers from Hoechst-Celanese Co. of Somerville, N.J. The resulting web of Example 15 was annealed or heatset using the apparatus described in FIG. 1.

The tentering apparatus was an aluminum plate 68.6 centimeters×25.4 centimeters×0.635 centimeters (27 inches×10 inches×0.25 inches) with 6.35 millimeter (0.25 inch) holes bored through the plate and spaced 9.5 millimeters (0.375 inches) on center to provide air flow through the plate and through the web. Between the rows of air holes and offset by 4.76 millimeters (0.188 inches), pins are uniformly spaced 2.86 centimeters (1.125 inches) apart. The pins are 15 gauge×18 gauge×36 gauge×7.62 centimeters (3 inches) CB-A Foster 20 (3-22-1.5B needle punching pins available from Foster Needle Co., Inc. Manitowoc, Wis.). Example 15 was tenter annealed for 10 minutes at 238° C. The sample was removed from the oven, allowed to cool to room temperature, and removed from the tentering device. With the exception of sample dimensions, percent web shrinkage was conducted in accordance with ASTM D 1204-84. Example 15 and Comparative Example C7 were marked with grid lines 12.7 centimeters×50.8 centimeters (5 inches×20 inches) and annealed for 10 minutes at 238° C. The results are set forth in Table 4.

TABLE 4

| Example No. | Web Basis Weight (grams/meter$^2$) | Percent Web Shrinkage Machine Direction | 238° C./10 Minutes Cross Direction |
|---|---|---|---|
| 15 | 377 | 2.3 | 0.0 |
| C7 | 366 | 18.6 | 9.9 |

The data of Table 4 show that although staple fibers of the comboweb (i.e., microfibers and staple fibers) improve dimensional stability, they are not capable of stabilizing to the extent of the tentering apparatus of the present invention.

Example 16

A PET nonwoven acoustical insulating web was prepared as described in U.S. Pat. No. 4,118,531 (Hauser). The webs comprised 65% melt blown microfibers prepared from polyethylene terephthalate (PET) 0.6 I.V. type 651000 available from 3M Company of St. Paul, Minn. The webs also included 35% crimp bulking fibers in the form of 3.8 cm (1.5 inch) long, 6 denier (25.1 micrometers in diameter), 3.9 crimps/centimeter (10 crimps per inch) polyester staple fibers available as Type T-295 fibers from Hoechst-Celanese Co. of Somerville, N.J. The resulting web of Example 16 was tenter annealed or heatset with the tentering apparatus of Example 15.

The sample of Example 16 was tenter annealed for 10 minutes at 180° C. using the tentering apparatus described in Example 1–5. The sample was removed from the oven, allowed to cool to room temperature, and removed from the tentering device. The sample of Example 16 had a web thickness of 3.4 centimeters and was evaluated in accordance with ASTM D1777-64 using 13.79 Pa (0.002 pounds per square inch) and a 30.5 centimeters×30.5 centimeters (12 inches×12 inches) presser foot. Example 16 had a web basis weight of 418 grams/meter$^2$ and was evaluated in accordance with ASTM D 3776-85. Example 16 had an EFD of 12.5 micrometers and was evaluated in accordance with ASTM F 778-88 at an air flow of 32 liters per minute. Sound absorption was evaluated in accordance with ASTM E1050 and the results are set forth in Table 5.

TABLE 5

| Example | Sound Absorption Coefficient per Frequency (Hz) | | | | | | | |
|---|---|---|---|---|---|---|---|---|
| No. | 160 | 200 | 250 | 315 | 400 | 500 | 630 | 800 |
| 16 | 0 | .07 | .10 | .12 | .16 | .20 | .25 | .33 |
| Example | Sound Absorption Coefficient per Frequency (Hz) | | | | | | | |
| No. | 1k | 1.25k | 1.6k | 2k | 2.5k | 3.15k | 4k | 5k | 6.3k |
| 16 | .41 | .50 | .62 | .72 | .79 | .81 | .79 | .79 | .82 |

The data of Table 5 show that dimensionally stable combowebs are effective sound absorbers.

Example 17 and Comparative Example C8

A poly (1,4-cyclohexylenedimethylene terephthalate) (PCT) nonwoven meltblown microfibrous web with a targeted basis weight of 53 grams/meter$^2$ was produced as described in Examples 1–5. The PCT meltblown microfibrous web was prepared from a resin designated Ektar 10820 available from Eastman Chemical Company, Kingsport, Tenn. The web of Example 17 was tenter annealed with the device described in Example 1–5 at 180° C. for 2 minutes, removed from the oven, allowed to cool to room temperature, and removed form the tentering apparatus. Example 17 and Comparative Example C8 were marked with grid lines 20.3 centimeters×20.3 centimeters (8 inches×8 inches) and annealed at 180° C. for 5 minutes. The webs were evaluated for shrinkage in accordance with ASTM D1204-84 (with the exception of sample dimensions). The results are set forth in Table 6.

TABLE 6

| Example No. | Web Basis Weight (grams/meter$^2$) | Percent Web Shrinkage Machine Direction | 180° C./5 Minutes Cross Direction |
|---|---|---|---|
| 17 | 53 | 0.8 | 0.4 |
| C8 | 53 | 36.7 | 35.2 |

The data of Table 6 show that other meltblown polyester type webs show significant shrinkage when annealed without tentering according to the present invention.

Patents and patent applications cited herein, including those cited in the Background, are incorporated by reference in total. It will be apparent to those skilled in the art that many changes can be made in the embodiments described above without departing from the scope of the invention. Thus, the scope of the present invention should not be limited to the methods and structures described herein, but only to methods and structures described by the language of the claims and the equivalents thereto.

What is claimed is:

1. An apparatus for tentering and annealing nonwoven fibrous web, comprising an annealing oven that heats a nonwoven web secured on a plurality of tentering points projecting distally from a tentering support, the tentering points being engaged with the interior portion of the web and being distributed so that the apparatus will restrain such web during annealing, wherein said tentering points are separated from each other by about 2.5 centimeters to about 50 centimeters.

2. An apparatus for tentering and annealing nonwoven fibrous web, comprising an energy source and a plurality of tentering points projecting distally from first and second tentering supports, the supports being engaged with and restraining between them the interior portion of the web, wherein the apparatus heats the web for a sufficient temperature and time so that the interior portion of the web is annealed while so restrained.

3. The apparatus of claim 2 wherein the plurality of tentering points comprise a plurality of tentering pins arranged to penetrate into the nonwoven fibrous web.

4. The apparatus of claim 2 wherein the plurality of tentering points comprise a plurality of tentering pins arranged to penetrate through the nonwoven fibrous web.

5. The apparatus of claim 2 wherein the tentering points are configured to compressively engage the nonwoven fibrous web at the plurality of tentering points.

6. The apparatus of claim 2 wherein the tentering points are generally uniformly distributed across the tentering support.

7. The apparatus of claim 2 wherein the tentering points define a grid of tentering pins each separated from each other by about 2.5 centimeters to about 50 centimeters.

8. The apparatus of claim 2 wherein the tentering points comprise a single row positioned to engage with the interior portion of the web.

9. The apparatus of claim 2 wherein the tentering points restrain the web in two dimensions.

10. The apparatus of claim 2 wherein the tentering points restrain the web in three dimensions.

11. An apparatus according to claim 2, wherein the distribution of tentering points allows contraction forces of relaxation and subsequent crystallization during annealing to be distributed generally uniformly across such web, with minimal web shrinkage or tearing.

12. An apparatus according to claim 2, wherein the apparatus avoids compressing the web during annealing so as to preserve the acoustical and thermal insulating properties of such web.

13. An apparatus according to claim 2, wherein the tentering support has a plurality of vent holes that permit airflow through the surface of the web.

14. An apparatus according to claim 2, wherein the energy source comprises an annealing oven and the web is drawn through the oven.

15. The apparatus of claim 1 wherein the plurality of tentering points comprises a plurality of tentering pins arranged to penetrate into the nonwoven fibrous web.

16. The apparatus of claim 1 wherein the plurality of tentering points comprises a plurality of tentering pins arranged to penetrate through the nonwoven fibrous web.

17. The apparatus of claim 1 wherein the tentering points are configured to compressively engage the nonwoven fibrous web at the plurality of tentering points.

18. The apparatus of claim 1 wherein the tentering points are generally uniformly distributed across the tentering support.

19. The apparatus of claim 1 wherein the tentering points define a grid of tentering pins.

20. The apparatus of claim 1 wherein the tentering points comprise a single row positioned to engage with the interior portion of the web.

21. The apparatus of claim 1 wherein the tentering points restrain the web in two dimensions.

22. The apparatus of claim 1 wherein the tentering points restrain the web in three dimensions.

23. An apparatus according to claim 1, wherein the distribution of tentering points allows contraction forces of relaxation and subsequent crystallization during annealing to be distributed generally uniformly across such web, with minimal web shrinkage or tearing.

24. An apparatus according to claim 1, wherein the apparatus avoids compressing the web during annealing so as to preserve the acoustical and thermal insulating properties of the web.

25. An apparatus according to claim 1, wherein the tentering support has a plurality of vent holes that permit airflow through the surface of the web.

26. An apparatus according to claim 1, wherein the energy source comprises an annealing oven and the web is drawn through the oven.

27. An apparatus for tentering and annealing nonwoven fibrous web, comprising an energy source and a plurality of tentering points projecting distally from a tentering support and engaged with and restraining the interior portion of the web, wherein the tentering points comprise a plurality of tentering pins arranged to penetrate through the web and the apparatus heats the web for a sufficient temperature and time so that the interior portion of the web is annealed while so restrained.

28. An apparatus for tentering and annealing nonwoven fibrous web, comprising an energy source and a plurality of tentering points projecting distally from a tentering support and engaged with and restraining the interior portion of the web, wherein the tentering points define a grid of tentering pins each separated from each other by about 2.5 centimeters to about 50 centimeters and the apparatus heats the web for a sufficient temperature and time so that the interior portion of the web is annealed while so restrained.

29. An apparatus for tentering and annealing nonwoven fibrous web, comprising an energy source and a plurality of tentering points projecting distally from a tentering support and engaged with and restraining the interior portion of the web, wherein the tentering points comprise a single row positioned to engage with the interior portion of the web and the apparatus heats the web for a sufficient temperature and time so that the interior portion of the web is annealed while so restrained.

30. An apparatus for tentering and annealing nonwoven fibrous web, comprising an energy source and a plurality of tentering points projecting distally from a tentering support and engaged with and restraining the interior portion of the web, wherein the tentering points restrain the web in three dimensions and the apparatus heats the web for a sufficient temperature and time so that the interior portion of the web is annealed while so restrained.

31. An apparatus for tentering and annealing nonwoven fibrous web, comprising an energy source and a plurality of tentering points projecting distally from a tentering support and engaged with and restraining the interior portion of the web, wherein the apparatus heats the web for a sufficient temperature and time so that the interior portion of the web is annealed while so restrained and the apparatus avoids compressing the web during annealing so as to preserve the acoustical and thermal insulating properties of such web.

32. An apparatus for tentering and annealing nonwoven fibrous web, comprising an energy source and a plurality of tentering points projecting distally from a tentering support and engaged with and restraining the interior portion of the web, wherein the tentering support has a plurality of vent holes that permit airflow through the surface of the web and the apparatus heats the web for a sufficient temperature and time so that the interior portion of the web is annealed while so restrained.

33. An apparatus for tentering and annealing nonwoven fibrous web, comprising an energy source and a plurality of tentering points projecting distally from a tentering support and engaged with and restraining the interior portion of the web, wherein the energy source comprises an annealing oven, the web is drawn through the oven and the apparatus heats the web for a sufficient temperature and time so that the interior portion of the web is annealed while so restrained.

* * * * *

UNITED STATES PATENT AND TRADEMARK OFFICE

CERTIFICATE OF CORRECTION

PATENT NO. : 6,371,749 B2
DATED : April 16, 2002
INVENTOR(S) : Thompson, Delton R. Jr.

It is certified that error appears in the above-identified patent and that said Letters Patent is hereby corrected as shown below:

Column 1,
Line 47, delete “trough” and insert in place thereof -- through --.

Column 10,
Line 64, delete the “,” between the words “the” and “analysis”.

Signed and Sealed this

Ninth Day of July, 2002

*Attest:*

*Attesting Officer*

JAMES E. ROGAN
*Director of the United States Patent and Trademark Office*